US011813731B2

(12) United States Patent
Williams et al.

(10) Patent No.: US 11,813,731 B2
(45) Date of Patent: Nov. 14, 2023

(54) CARRIER HAVING A RIGID CONTAINER AND SLEEVE ORGANIZER

(71) Applicant: GROWN-UP LICENSES LIMITED, Tai Po (HK)

(72) Inventors: Matthew Williams, Lighthouse Point, FL (US); Ricky Lam, Kowloon (HK)

(73) Assignee: GROWN-UP LICENSES LIMITED, N.T. (HK)

( * ) Notice: Subject to any disclaimer, the term of this patent is extended or adjusted under 35 U.S.C. 154(b) by 0 days.

(21) Appl. No.: 17/504,844

(22) Filed: Oct. 19, 2021

(65) Prior Publication Data

US 2022/0118601 A1 Apr. 21, 2022

Related U.S. Application Data

(60) Provisional application No. 63/094,447, filed on Oct. 21, 2020.

(51) Int. Cl.

| | |
|---|---|
| ***B25H 3/02*** | (2006.01) |
| ***A45C 13/02*** | (2006.01) |
| ***A45C 13/04*** | (2006.01) |

(52) U.S. Cl.

CPC ..... *B25H 3/022* (2013.01); *A45C 13/02* (2013.01); *A45C 13/04* (2013.01)

(58) Field of Classification Search

CPC ..... A45C 13/02; A45C 13/04; A45C 5/06; A45C 11/24; A45C 13/36; B25H 3/02

USPC ..... 206/372

See application file for complete search history.

(56) References Cited

U.S. PATENT DOCUMENTS

| | | | | |
|---|---|---|---|---|
| 3,358,725 | A | 12/1967 | Bussard | |
| 4,765,579 | A | 8/1988 | Robbins | |
| 4,867,332 | A * | 9/1989 | Mains | B25H 3/04 206/372 |
| 4,993,551 | A * | 2/1991 | Lindsay | B25H 3/00 383/7 |
| 5,174,447 | A * | 12/1992 | Fleming | B25H 3/00 220/500 |
| D376,454 | S * | 12/1996 | Fierek | D32/54 |
| 5,848,701 | A * | 12/1998 | Riccabona | H02G 11/02 439/501 |
| D417,079 | S | 11/1999 | Heltzel | |
| 6,085,902 | A * | 7/2000 | Fang | B25H 3/00 220/735 |

(Continued)

FOREIGN PATENT DOCUMENTS

| | | |
|---|---|---|
| JP | 2011104734 | 6/2011 |
| WO | 2019005205 | 1/2019 |

*Primary Examiner* — Ernesto A Grano

(74) *Attorney, Agent, or Firm* — DUANE MORRIS LLP; Gregory M. Lefkowitz; Randall C. Pyles

(57) ABSTRACT

A portable organizer includes a structural member, including a base and a plurality of walls extending up from the base, wherein upper edges of the plurality of walls define an upper opening so that the structural member is open-topped; a sleeve including a sleeve outer layer and a sleeve inner layer joined along a transition edge, wherein the sleeve inner layer includes a sleeve inner wall and a sleeve base, and the sleeve outer layer includes a sleeve outer wall, and the sleeve fits over the plurality of walls; and a frame that fits over the upper edges and the transition edge to secure the sleeve to the structural member.

19 Claims, 11 Drawing Sheets

(56) References Cited

U.S. PATENT DOCUMENTS

| | | | | |
|---|---|---|---|---|
| 6,138,827 | A * | 10/2000 | Marshall | B25H 3/00 220/735 |
| 6,151,910 | A * | 11/2000 | Hazen | F25D 3/08 220/592.2 |
| 6,189,697 | B1 * | 2/2001 | Davis | A45C 11/008 206/581 |
| 6,315,310 | B1 * | 11/2001 | Hurt | B62B 1/264 224/904 |
| 6,536,590 | B1 * | 3/2003 | Godshaw | B25H 3/00 248/210 |
| 7,314,133 | B2 | 1/2008 | Redzisz | |
| 7,604,103 | B2 | 10/2009 | Hamlin | |
| D635,769 | S | 4/2011 | Sosnovsky | |
| 7,950,509 | B2 | 5/2011 | Redzisz | |
| 8,074,798 | B2 | 12/2011 | Williams | |
| 8,662,300 | B1 * | 3/2014 | Arena | B25H 3/00 206/372 |
| D736,521 | S | 8/2015 | Tarter | |
| 9,914,206 | B1 | 3/2018 | Guirlinger | |
| D823,600 | S | 7/2018 | Pennington | |
| D824,671 | S | 8/2018 | Pennington | |
| 10,131,180 | B1 | 11/2018 | Marotta | |
| D846,282 | S | 4/2019 | Brouard | |
| D885,055 | S | 5/2020 | Zhao | |
| 10,717,184 | B2 * | 7/2020 | Frazier | B25H 3/00 |
| 2006/0144732 | A1 * | 7/2006 | Kaplan | B25H 3/00 206/349 |
| 2007/0103892 | A1 | 5/2007 | McDaniel | |
| 2008/0000914 | A1 * | 1/2008 | Frankenstein | A45C 13/02 220/507 |
| 2008/0179370 | A1 | 7/2008 | Williams | |
| 2008/0308566 | A1 | 12/2008 | Fierek | |
| 2013/0001118 | A1 | 1/2013 | Kinskey | |
| 2015/0034653 | A1 * | 2/2015 | Sirko | B65F 1/06 220/495.08 |
| 2016/0059992 | A1 | 3/2016 | Pierre-Pipkin | |
| 2019/0255696 | A1 | 8/2019 | Woolery | |
| 2020/0147781 | A1 | 5/2020 | Squiers | |
| 2020/0165036 | A1 | 5/2020 | Squiers | |
| 2020/0298391 | A1 | 9/2020 | Frazier | |

* cited by examiner

CARRIER HAVING A RIGID CONTAINER AND SLEEVE ORGANIZER

CROSS REFERENCE TO RELATED APPLICATIONS

This application claims the benefit of U.S. Provisional Patent Application No. 63/094,447, filed Oct. 21, 2020, which is hereby incorporated by reference for all purposes as if fully set forth herein.

TECHNICAL FIELD

The present disclosure relates generally to bags or carriers for tools or other items, and more particularly, to a self-supporting portable carrier having organizational features.

SUMMARY

In an embodiment of the present disclosure, a portable organizer includes a structural member, including a base and a plurality of walls extending up from the base, wherein upper edges of the plurality of walls define an upper opening so that the structural member is open-topped; a sleeve including a sleeve outer layer and a sleeve inner layer joined along a transition edge, wherein the sleeve inner layer includes a sleeve inner wall and a sleeve base, and the sleeve outer layer includes a sleeve outer wall, and the sleeve fits over the plurality of walls; and a frame that fits over the upper edges and the transition edge to secure the sleeve to the structural member.

In an embodiment, the plurality of walls include a first end wall and a second end wall opposite the first end wall, wherein a distance between a bottom of the first end wall and a bottom of the second end wall at the base is smaller than a distance between a top of the first end wall and a top of the second end wall at the upper edges.

In an embodiment, the plurality of walls includes a first side wall and a second side wall opposite the first side wall, wherein a distance between a bottom of the first side wall and a bottom of the second side wall at the base is smaller than a distance between a top of the first side wall and a top of the second side wall at the upper edges.

In an embodiment, the frame snaps over the upper edges and the transition edge.

In an embodiment, the upper edges define a rectangular shape and the frame includes a rectangular-shaped frame channel that fits over the upper edges.

In an embodiment, the frame channel has a generally U-shaped cross-section that fits over the upper edges, and from the upper edges toward the base, sides of the U-shaped cross-section tilt inward. The frame and the structural member can include a pair of matching holes, and a fastener passes through the pair of matching holes to secure the frame and the structural member together.

In an embodiment, the sleeve inner layer covers an inside of the structural member, and the sleeve outer layer covers a portion of an outside of the plurality of walls. A sleeve base can be secured to the base.

In an embodiment, the sleeve outer layer includes a sleeve lower edge, wherein a perimeter of the sleeve lower edge is smaller than a perimeter of the upper edges. A perimeter of the sleeve lower edge can be smaller than a perimeter of the transition edge. The sleeve lower edge can be reinforced. The sleeve outer layer can cover less than all of an outside of the plurality of walls. The sleeve base can extend lower than the sleeve lower edge.

In an embodiment, a perimeter of the sleeve base is smaller than a perimeter of the transition edge.

In an embodiment, the structural member is defined from a single, unitary piece of material. The structural member can be defined of a single, unitary piece of molded plastic.

An embodiment can further include a plurality of feet attached to an outside of the structural member.

In an embodiment, one of the sleeve inner wall and the sleeve outer wall includes a plurality of compartments.

In an embodiment, one or both of the sleeve inner wall and the sleeve outer wall includes a base layer and an accessory layer. A pocket for holding an item can be defined by the accessory layer. An additional pocket for holding an item can be defined between the base layer and the accessory layer.

The above and other features, elements, characteristics, steps, and advantages of the present invention will become more apparent from the following detailed description of preferred embodiments of the present invention with reference to the attached drawings.

DETAILED DESCRIPTION

The present disclosure describes a portable carrier for items such as tools and work pieces. The portable carrier can include a rigid container and a flexible sleeve covering that can be secured to the container to provide a plurality of compartments and organizing features. The sleeve can also provide a lining to an interior compartment defined by the container. For example, the rigid container can include side walls defining an interior for holding items. The sleeve can include pockets for receiving the side walls, thereby lining the interior and providing outer-facing coverage of the container. The inner-facing and outer-facing surfaces of the sleeve can include compartments and other organizing features for holding items such as tools. A frame can be connected to the sleeve and the rigid container to lock the container and sleeve to each other and complete the assembly. The assembly fits together in a snug, friction-fit combination to provide a solid and robust tool bag construction.

Figure 1B:
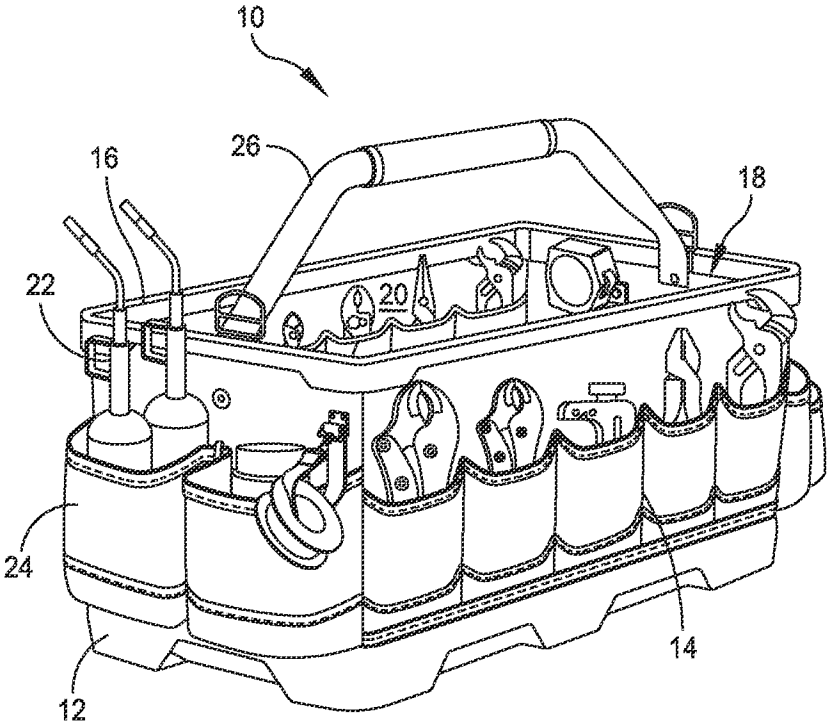
FIGS. 1A and 1B are perspective views of a tool bag including tools being held in a plurality of pockets.
Figure 1A:
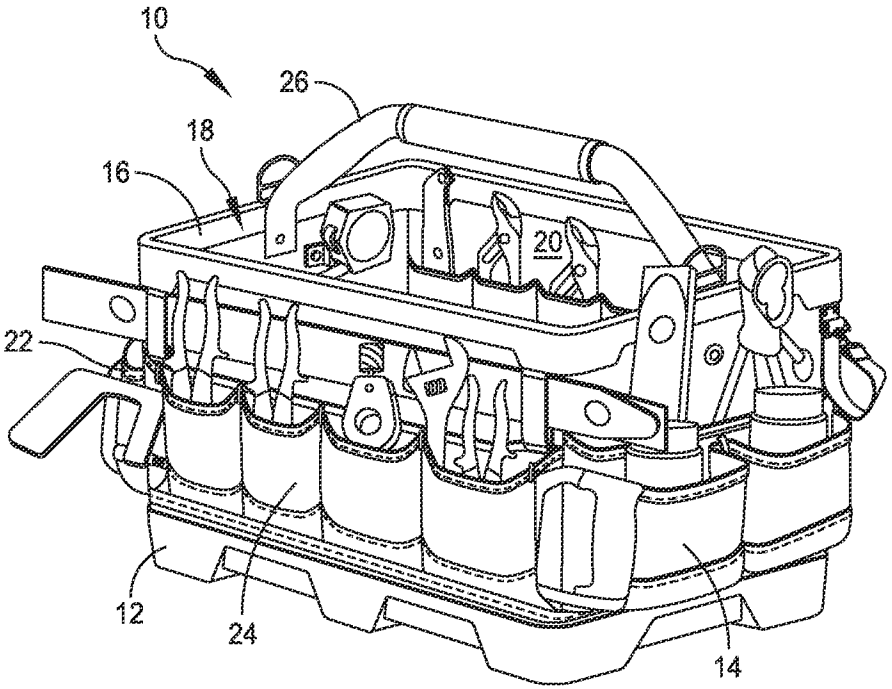
Figure 2B:
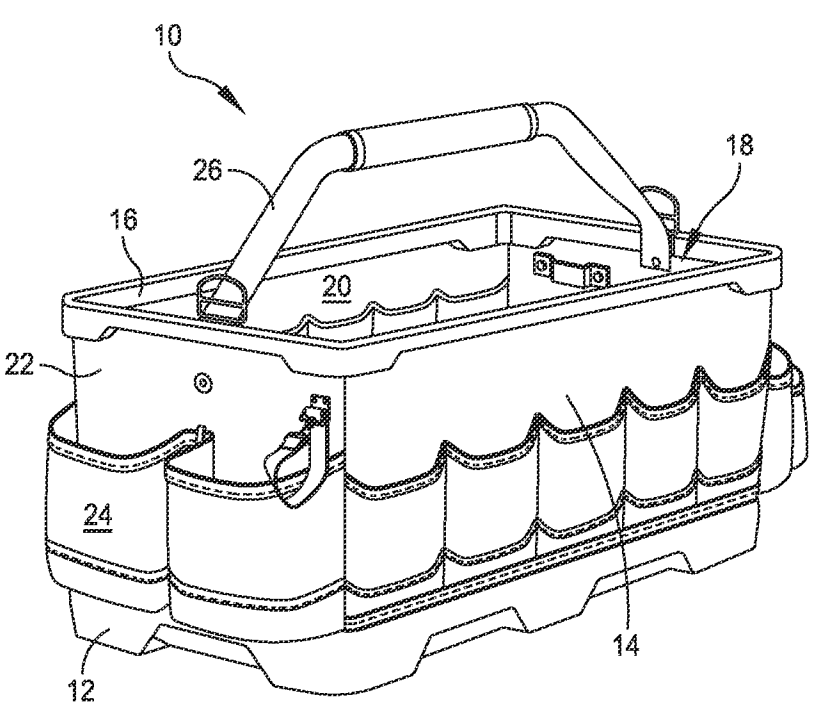
FIGS. 2A and 2B are perspective views of the tool bag without the tools.
Figure 2A:
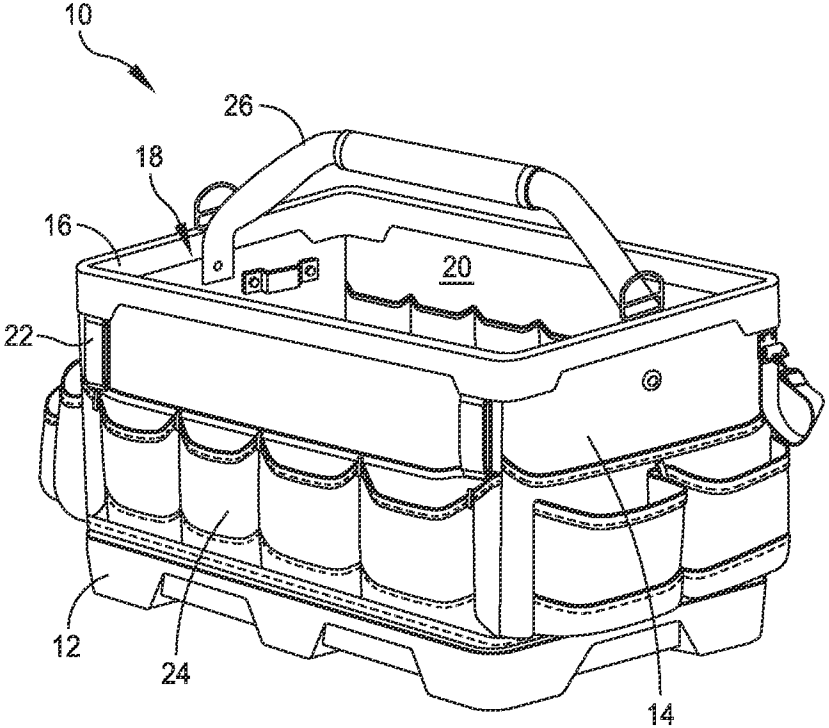
Figure 2C:
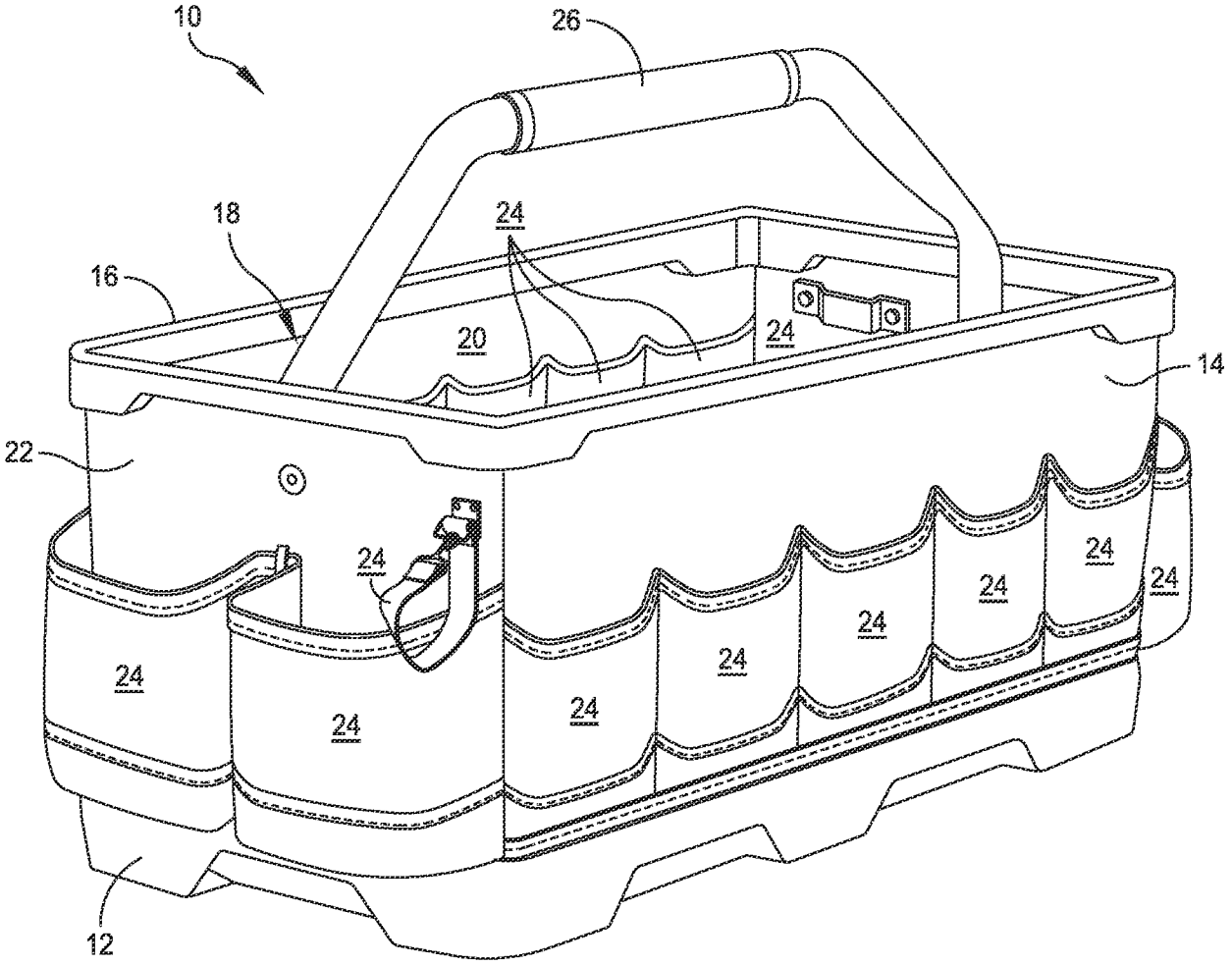
FIG. 2C is a line drawing of a perspective view of the tool bag without the tools in the pockets.

FIGS. 1A and 1B are perspective views of a portable carrier 10, according to a disclosed embodiment. The carrier 10 can include a container 12, a sleeve 14, and a frame 16. The container 12 can be a structural member that defines an interior compartment 18 for receiving items to be carried, such as tools or work pieces. The sleeve 14 can be configured to line the interior compartment 18 with inward-facing surfaces 20 and provide outward-facing surfaces 22. The inward-facing surfaces 20 and outward-facing surfaces 22 can include a plurality of compartments 24 for receiving tools or other items for transport by the carrier 10. The carrier 10 can further include a handle 26 for lifting and transporting the carrier 10. The handle 26 can be attached to the container 12, the sleeve 14, and/or the frame 16. For example, the handle 26 can be secured to the container 12 after assembly. FIGS. 2A, 2B, and 2C are views of the carrier 10 without the tools held in the compartments 24.

Figure 3:
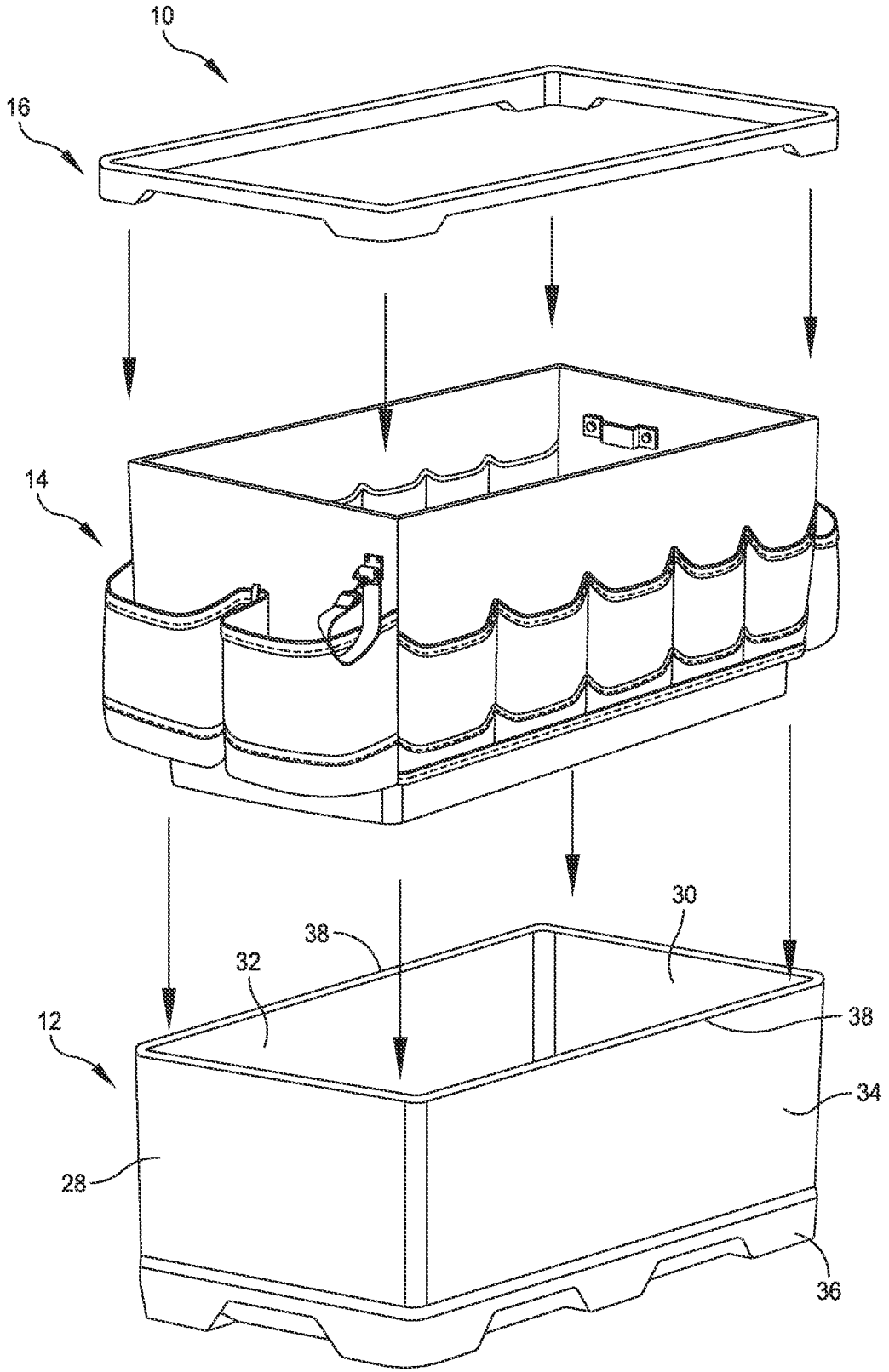
FIG. 3 is an exploded view showing different components of the tool bag prior to assembly.

FIG. 3 is an exploded view of the carrier 10 showing the container 12, sleeve 14, and frame 16. The container 12 can include a plurality of walls, including end walls 28, 30 and side walls 32, 34. The walls 28, 30, 32, 34 extend upwardly from a base 36 to an upper edge 38. The base 36 and walls 28, 30, 32, 34 can be separate or integrally defined as one unitary piece. For example, the container 12 can be molded from a polymer, plastic, composite, or any other suitable material, although it should be understood that other self-supporting materials (e.g., metals, fabrics, etc.) are possible. The container 12 can be rigid to provide a self-supporting skeleton structure to the carrier 10.

Figure 5B:
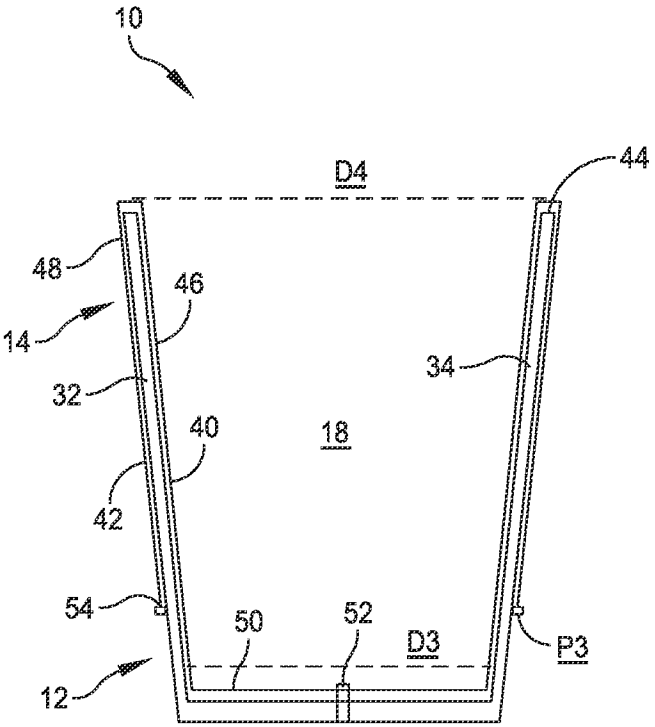
FIG. 5B is a cross-sectional view of the tool bag showing a width dimension taken along line B-B of FIG. 4A.
Figure 5A:
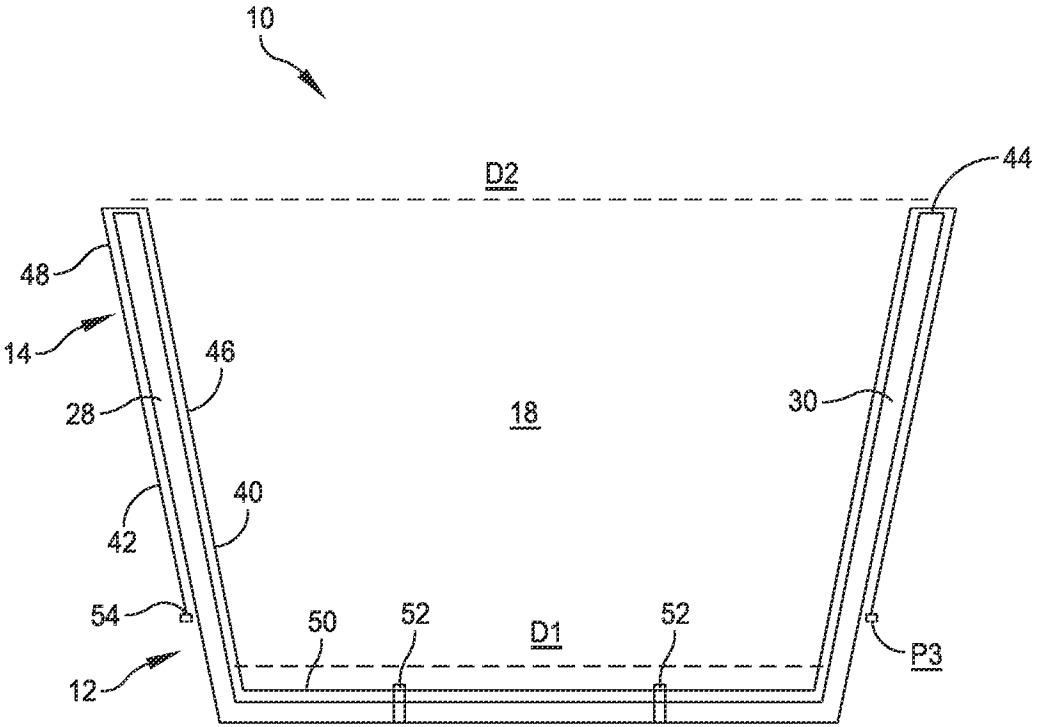
FIG. 5A is a cross-sectional view of the tool bag showing a length dimension taken along line A-A of FIG. 4A.

The sleeve 14 is structured to cover the container 12 in a fitted manner, and includes an inner layer 40, an outer layer 42, and a transition edge 44 connecting the inner layer 40 to the outer layer 42, as shown in cross-sectional views FIGS. 5A and 5B. The sleeve 14 thereby creates a cavity for receiving the walls 28, 30, 32, 34 of the container 12. The frame 16, in at least some embodiments, fits and/or snaps over the upper edges 38 of the walls 28, 30, 32, 34 and the transition edge 44 to secure the sleeve 14 to the container 12. In an exemplary embodiment, upper edges 38 of the walls 28-34 of the container 12 define a rectangular shape and the frame 16 has a matching rectangular shape that accommodates the upper edges of the container 12. While polygonal shapes may be particularly beneficial for the carriers 10 described herein, other shapes are envisioned. In other embodiments, walls of the container 12 can define other opening shapes to be circular, oval, hexagonal, octagonal, or any other suitable shape. The frame 16 can include enlarged corners or corners that flare out along the upper edges 38 for providing a tight fit at the corners of the frame 16.

Figure 4A:
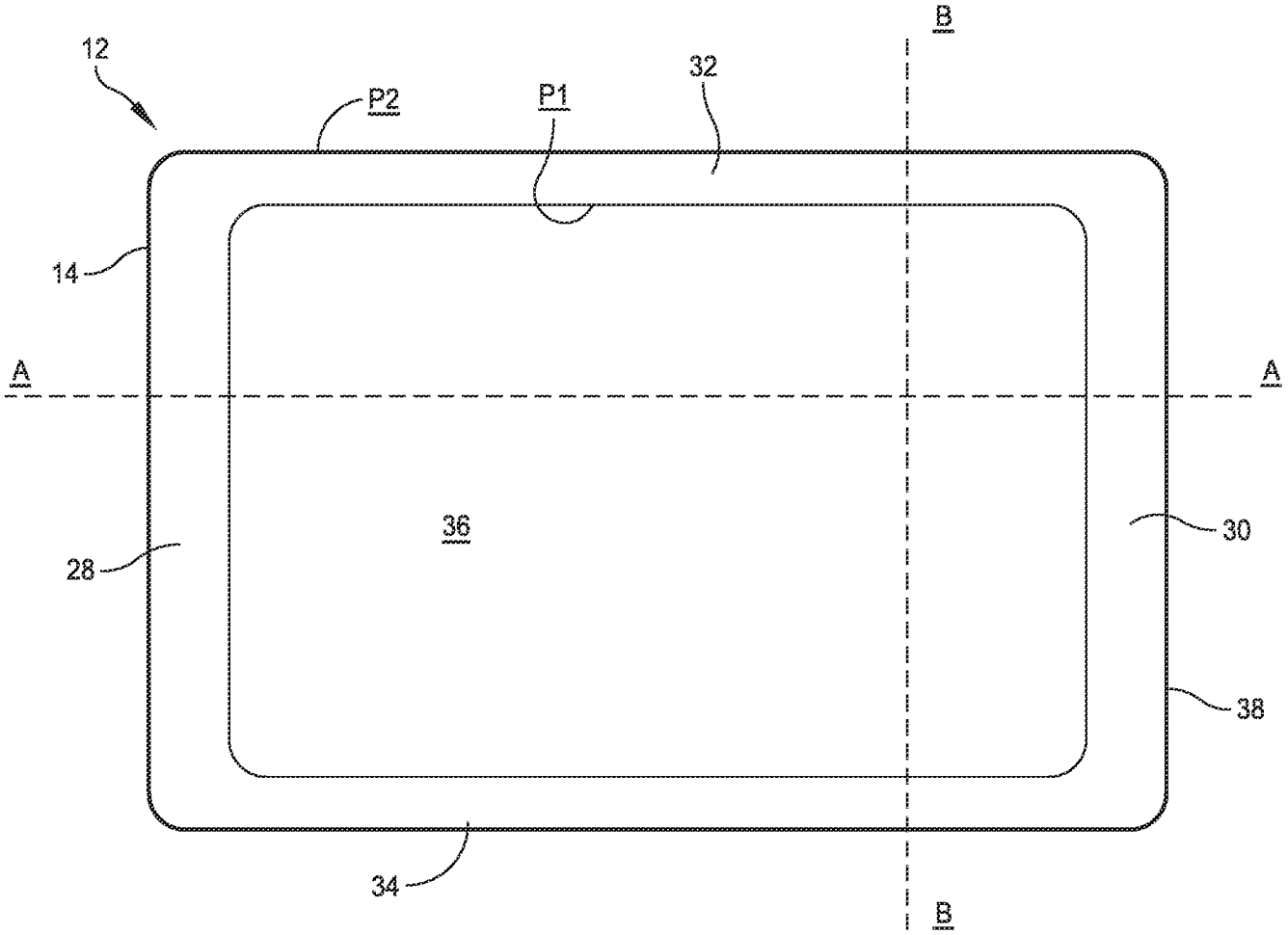
FIG. 4A is a top view of a container and sleeve of the tool bag.
Figure 4B:
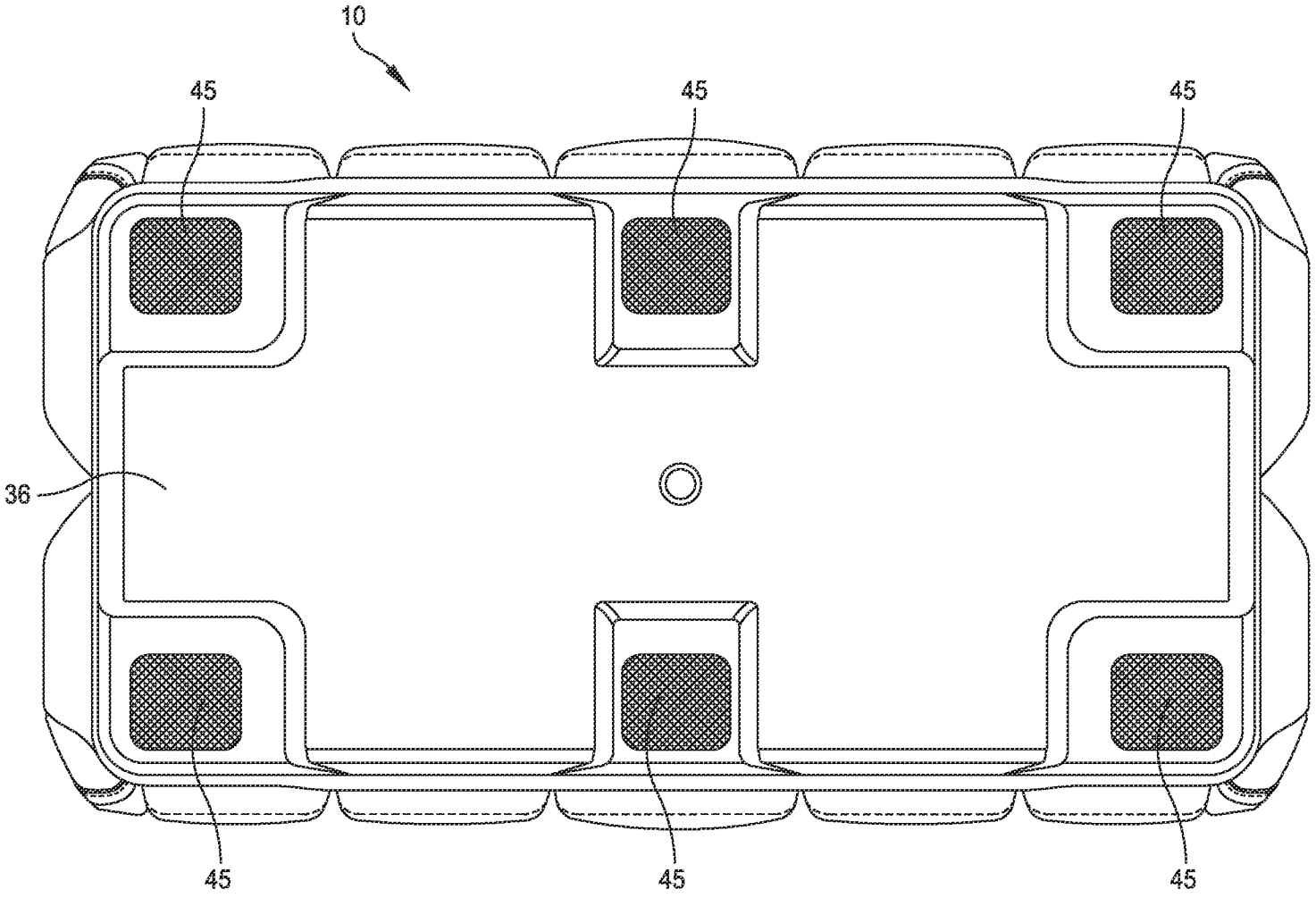
FIG. 4B is a bottom view of a container and sleeve of the tool bag.

FIG. 4A is a top view of the container 12 and the sleeve 14 fitted onto the container 12 (not showing the compartments 24 or handle 26). As shown, the end walls 28, 30 and side walls 32, 34 slope inwardly such that a perimeter P1 at the base 36 is smaller than a perimeter P2 at the top edge 38. FIG. 4B is a bottom view of the container 12 showing the base 36. The base 36 can include features to promote self-supporting of the container, such as integrally-formed feet 45 to contact a surface below the carrier 10. Alternatively, the feet 45 can be attached to the base 36 as separate components.

FIGS. 5A and 5B further show cross-sectional views of the carrier 10, including the sleeve 14 fitted over the upper edges 38 of the container 12. The frame is not shown in order to show other features of the carrier 10. The sleeve 14 includes the inner layer 40, the outer layer 42, and the transition edge 44. The inner layer 40 can include a sleeve inner wall surface 46 for covering the inner surfaces of the walls 28, 30, 32, 34 and a sleeve base 50 for covering an inner surface of the base 36, and the outer layer 42 may include a sleeve outer wall surface 48 for covering at least a portion of the outer surfaces of the walls 28, 30, 32, 34. The sleeve base 50 can be connected and secured to the base 36, using a connector, including but not limited to fasteners 52 (e.g., screws) or adhesive.

In some embodiments, the outer layer 42 can include a sleeve edge 54. The sleeve edge 54 can define an opening into the sleeve between inner layer 40 and outer layer 42 that receives the walls 28, 30, 32, 34 of the container 12. The sleeve edge 54 can define a perimeter P3 that is smaller than the perimeter P2 defined by the upper edge 38 and the transition edge 44. The perimeter P3 at the sleeve edge 54 can be greater than or equal to the perimeter P1 of the base 36, depending on the positioning of the sleeve edge 54. In this way, the sleeve 14 can be fabricated to match the slight taper of the container 12 and contribute to the snug fit when assembled. The sleeve edge 54 can be reinforced (e.g., a binding) to help prevent tearing/damage and limit stretching. The reinforcement can also provide a strong surface for keeping the sleeve 14 from riding up the walls 28, 30, 32, 34 of the container 12. In some embodiments, as shown in FIGS. 5A and 5B, the sleeve edge 54 can be positioned above the sleeve base 50 when the carrier 10 is fully assembled.

As shown, the end walls 28, 30 can include a flared configuration in which a distance D1—shown as a dotted line—between the bottom of the end wall 28 and the bottom of the end wall 30 is smaller than a distance D2—shown as a dotted line—between the top of the end wall 28 and the top of the end wall 30. As shown in FIG. 5B, the side walls 32, 34 can be similarly configured at an angle with respect to each other such that a distance D3—shown as a dotted line—between the bottom of the first side wall 32 and the bottom of the second side wall 34 is smaller than a distance D4—shown as a dotted line—between the top of the first side wall 32 and the top of the second side wall 34. As a result, the end walls 28 and 30 and side walls 32 and 34 flare-out at an obtuse angle with respect to each other, helping to provide a friction fit for the sleeve 14 (e.g., the outer layer 42) over the container 12. The sleeve 14 can be constructed from a flexible fabric material to fit snugly over the container 12.

Figure 6:
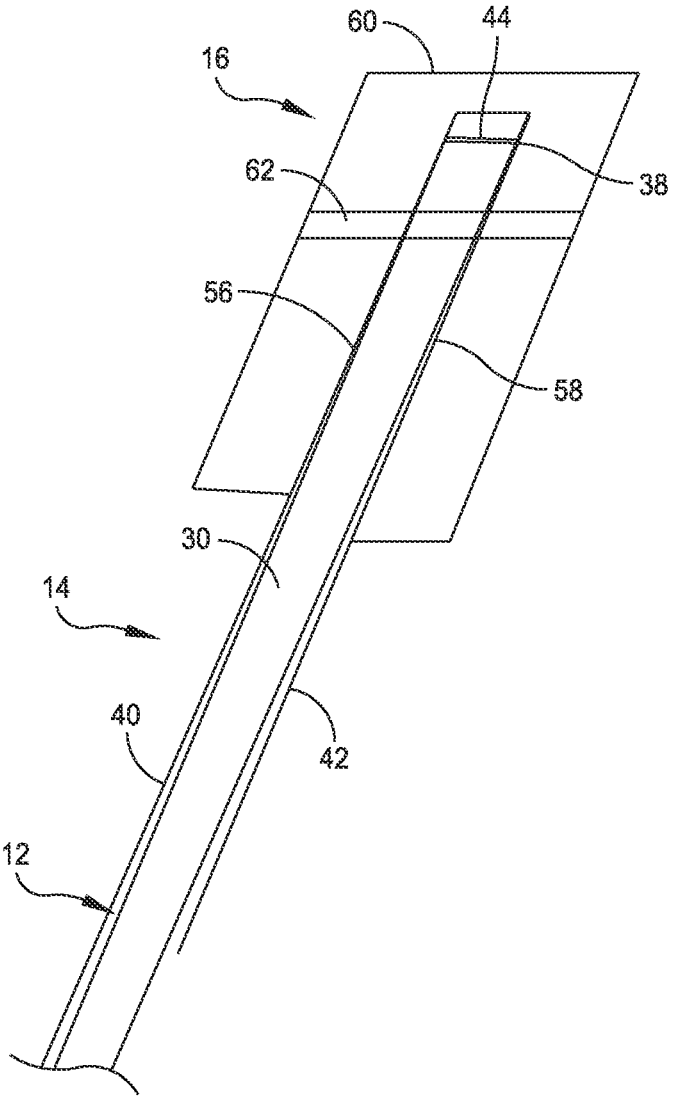
FIG. 6 is a close-up cross-sectional view of the tool bag at an upper edge thereof.

FIG. 6 is a close-up cross-sectional view of a portion of the top edge of the carrier 10, including the frame 16 positioned over the end wall 30, portions of the inner layer 40 and outer layer 42, and covering the transition edge 44. The frame 16 can include a U-shape having inner walls 56, 58 that extend from a connecting edge 60 of the frame 16. The inner walls 56, 58 can be angled in the same direction, e.g., toward a center of the carrier 10 to match the angle of the walls 28, 30, 32, 34. The U-shaped frame 16 thereby produces a friction fit that grasps the combined top edge of the container 12 and sleeve 14 and holds the container-sleeve assembly together. The inner walls 56, 58 can be parallel to each other, or, in some embodiments, the inner walls 56, 58 can converge toward each other toward the base of the U-shape channel to form a wedge-shaped cavity to enhance the friction fit over the upper edges 38 of the walls 28, 30, 32, 34. In some embodiments, as shown in FIG. 6, a fastener 62 can be inserted through the container 12, sleeve 14, and frame 16 to further secure the assembly together. For example, the frame 16, sleeve 14, and the container 12 can include at least one pair of matching holes, and a fastener 62

(e.g., a rivet, screw, bolt, etc.) passes through at least one pair of matching holes to secure the frame 16, sleeve 14, and container 12 together.

Returning to FIGS. 2A-2C, the sleeve 14 can include the plurality of compartments 24 incorporated onto the inner layer 40 and/or outer layer 42. The plurality of compartments 24 can include pockets, loops, slots, buckles, connectors, etc., that enable carrier 10 to hold items in addition to items being placed inside the interior compartment 18.

Figure 7:
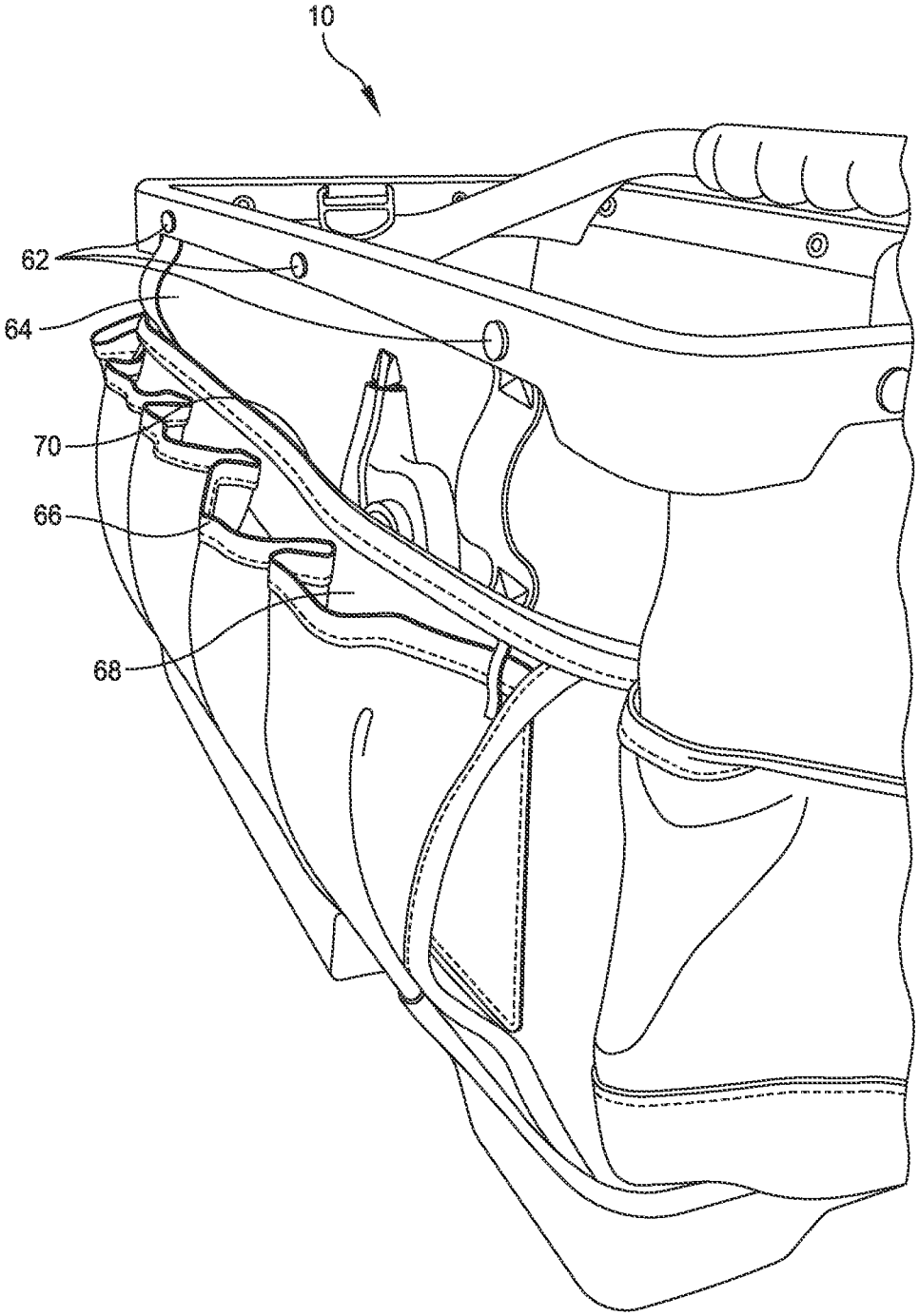
FIG. 7 is a close-up perspective view of a portion of the tool-bag, according to an embodiment.
Figure 8:
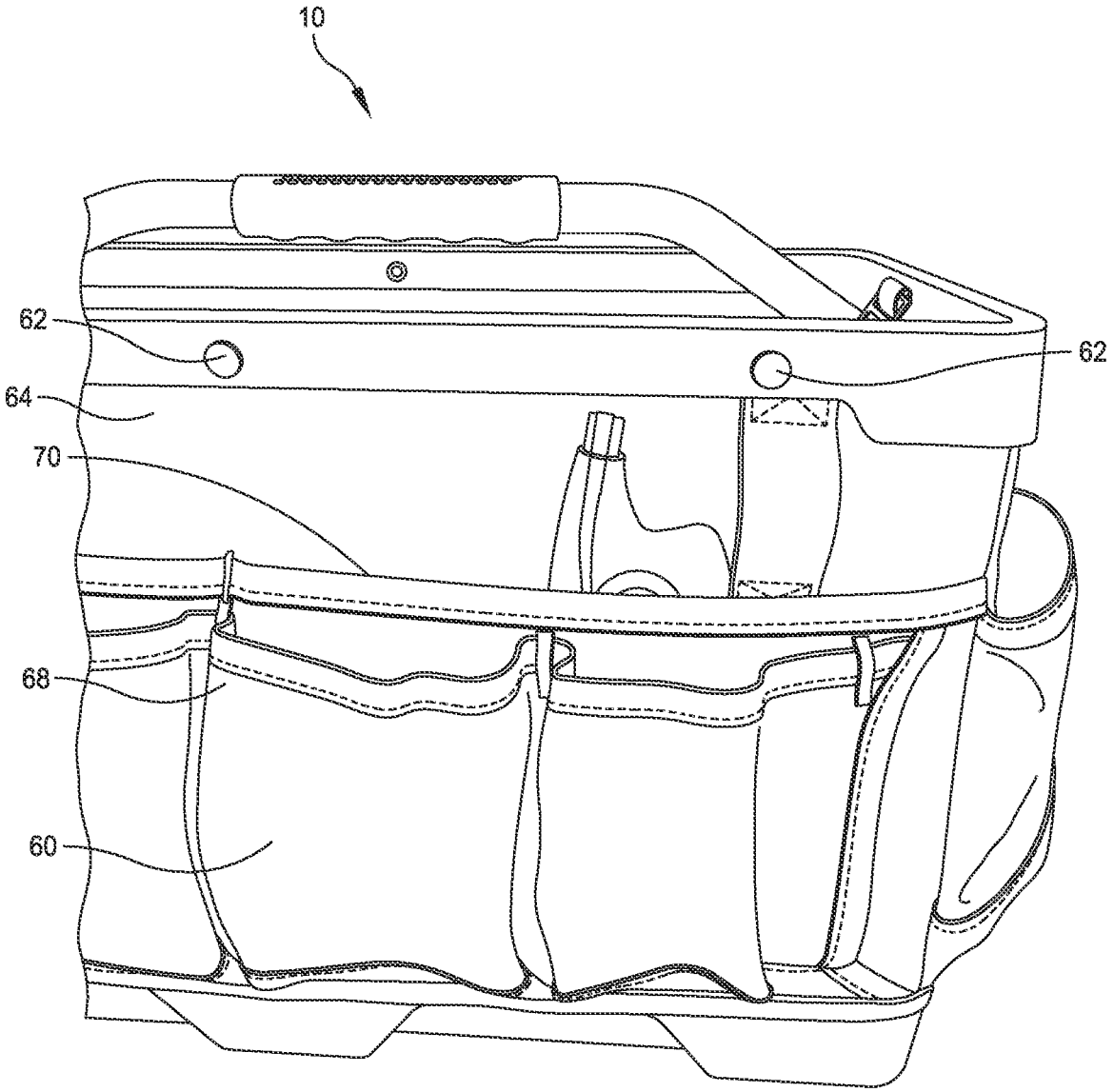
FIG. 8 is a close-up front-view of the tool bag, according to an embodiment.
Figure 9:
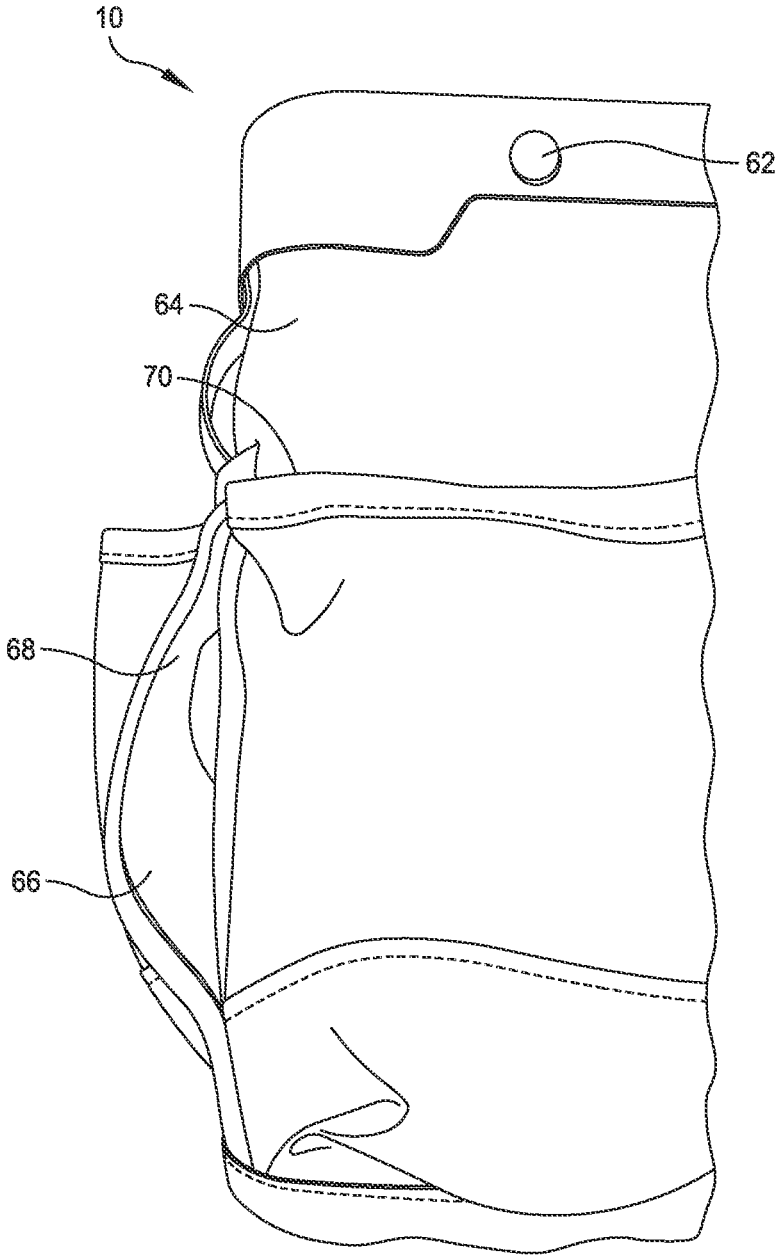
FIG. 9 is a close-up side-view of the tool bag, according to an embodiment.

FIGS. 7 and 8 are views of one side of the outer layer 42 of the sleeve 14, including a base layer 64 that interfaces with the container 12, and an accessory layer 66 attached to the outer surface of the base layer 64. The accessory layer 66 can include a plurality of compartments 68 for receiving items. In addition, a pocket 70 can be defined between the base layer 64 and the accessory layer 66 for receiving additional items to be carried. In some embodiments, the base layer 64 and accessory layer 66 can be fabricated from different materials. For example, accessory layer 66 can be more flexible than the base layer 64 to allow stretching to accommodate items held in the compartments and pockets 68, 70. FIG. 9 is a side view of the accessory layer 66, further illustrating that that the compartments 68 can include side-openings to accommodate larger items held horizontally along a length or width of the carrier 10.

Disclosed embodiments include a carrier assembly having a rigid structure while accommodating fabric or flexible pockets, compartments, and other carrier features in an efficient space. A flexible sleeve having the customized compartments can be slid over the rigid container and generally held in place due to friction and a snug fit based on a tapered configuration of the container and a close tolerance fabrication of the sleeve. A top-edge frame element can be fit over the corresponding top edges of the container and sleeve to lock the assembly in place, through an additional friction fit and optional fasteners or adhesive. The overall assembly thus provides a robust carrier with securely attached compartments and pockets that are flexible and customizable depending on the fabrication of the sleeve. A handle can be securely attached to the assembly to enable ease of handling the carrier and carrying any items in the compartments, including the main interior compartment of the assembly. Various layers of fabric can be included in the sleeve construction to accommodate the various pockets and compartments for different shapes of tools and items to be carried.

Although embodiments have been described in terms of exemplary features, they are not limited thereto. Rather, the appended claims should be construed broadly, to include other variants and embodiments, which may be made by those skilled in the art without departing from the scope and range of equivalents.

What is claimed is:

1. A portable organizer, comprising:

a structural member, including a base and a plurality of walls extending up from the base, wherein upper edges of the plurality of walls define an upper opening so that the structural member is open-topped;

a sleeve including a sleeve outer layer and a sleeve inner layer joined along a transition edge, wherein the sleeve inner layer includes a sleeve inner wall and a sleeve base, and the sleeve outer layer includes a sleeve outer wall, and the sleeve fits over the plurality of walls; and a frame that fits over the upper edges and the transition edge to secure the sleeve to the structural member, wherein the sleeve outer layer includes a sleeve lower edge, and a length of an entire perimeter of the sleeve lower edge is smaller than a length of an entire perimeter of the upper edges.

2. The portable organizer of claim 1, wherein the plurality of walls include a first end wall and a second end wall opposite the first end wall, wherein a distance between a bottom of the first end wall and a bottom of the second end wall at the base is smaller than a distance between a top of the first end wall and a top of the second end wall at the upper edges.

3. The portable organizer of claim 1, wherein the plurality of walls include a first side wall and a second side wall opposite the first side wall, wherein a distance between a bottom of the first side wall and a bottom of the second side wall at the base is smaller than a distance between a top of the first side wall and a top of the second side wall at the upper edges.

4. The portable organizer of claim 1, wherein the frame snaps over the upper edges and the transition edge.

5. The portable organizer of claim 1, wherein the upper edges define a rectangular shape and the frame includes a rectangular-shaped frame channel that fits over the upper edges.

6. The portable organizer of claim 5, wherein the frame channel has a generally U-shaped cross-section that fits over the upper edges, and from the upper edges toward the base, sides of the U-shaped cross-section tilt inward.

7. The portable organizer of claim 6, wherein the frame and the structural member include a pair of matching holes, and a fastener passes through the pair of matching holes to secure the frame and the structural member together.

8. The portable organizer of claim 1, wherein the sleeve inner layer covers an inside of the structural member, and the sleeve outer layer covers a portion of an outside of the plurality of walls.

9. The portable organizer of claim 8, wherein a sleeve base is secured to the base.

10. The portable organizer of claim 1, wherein a perimeter of the sleeve lower edge is smaller than a perimeter of the transition edge.

11. The portable organizer of claim 1, wherein the sleeve lower edge is reinforced.

12. The portable organizer of claim 1, wherein the sleeve outer layer covers less than all of an outside of the plurality of walls.

13. The portable organizer of claim 1, wherein the sleeve base extends lower than the sleeve lower edge.

14. The portable organizer of claim 1, wherein a perimeter of the sleeve base is smaller than a perimeter of the transition edge.

15. The portable organizer of claim 1, wherein the structural member is defined from a single, unitary piece of material.

16. The portable organizer of claim 1, wherein the structural member is defined of a single, unitary piece of molded plastic.

17. The portable organizer of claim 1, wherein one of the sleeve inner wall and the sleeve outer wall includes a plurality of compartments.

18. The portable organizer of claim 1, wherein one or both of the sleeve inner wall and the sleeve outer wall include a base layer and an accessory layer.

19. The portable organizer of claim 18, wherein a pocket for holding an item is defined by the accessory layer.

* * * * *